United States Patent [19]

Rathmell

[11] Patent Number: 4,615,674

[45] Date of Patent: Oct. 7, 1986

[54] INCINERATOR SYSTEM

[75] Inventor: Richard K. Rathmell, Londondery, N.H.

[73] Assignee: Wolverine Corporation, Methuen, Mass.

[21] Appl. No.: 776,008

[22] Filed: Sep. 13, 1985

[51] Int. Cl.[4] ..... F23D 11/44

[52] U.S. Cl. ..... 431/215; 110/204; 431/115

[58] Field of Search ..... 431/215, 115, 116, 11; 110/204

[56] References Cited

U.S. PATENT DOCUMENTS

| | | | |
|---|---|---|---|
| 1,802,766 | 4/1931 | Kerr . | |
| 2,308,757 | 1/1943 | Hulsberg . | |
| 3,263,747 | 8/1966 | McKay . | |
| 3,948,315 | 4/1976 | Powell . | |
| 3,974,022 | 8/1976 | Lauro . | |
| 4,047,881 | 9/1977 | Eschenauer . | |
| 4,052,143 | 10/1977 | Sandviknes | 431/215 |
| 4,171,014 | 10/1979 | Straub . | |
| 4,256,783 | 3/1981 | Takada . | |
| 4,312,320 | 1/1982 | Jennings . | |
| 4,391,227 | 7/1983 | Forster et al. | 431/215 X |
| 4,408,983 | 10/1983 | Masters et al. | 431/116 |
| 4,416,325 | 11/1983 | Barratt . | |

*Primary Examiner*—Edward G. Favors

[57] ABSTRACT

A heat exchanger-combustion chamber construction includes a combustion chamber and a heat exchanger chamber. Disposed in the heat exchanger chamber is an array of inlet tubes, the outlets of which discharge into the combustion chamber. Combustion products discharged from the combustion chamber are flowed over the inlet tubes in heat exchange relation. An array of aspirator sleeves of larger inner dimension than the outer dimension of the inlet tubes is secured to divider structure between the heat exchanger chamber and the combustion chamber, each aspirator sleeve receiving the outlet end of a heat exchanger tube while permitting longitudinal movement of the heat exchanger tube within the sleeve (due to thermal expansion, for example). Inlet vapor flow through the tubes produces a reduced pressure effect in the sleeves to a value below the pressure of the exhaust gas in the heat exchanger chamber so that there is recycle flow of a small fraction of the combustion products through the aspirator sleeves back into the combustion chamber.

11 Claims, 7 Drawing Figures

INCINERATOR SYSTEM

This invention relates to heat exchanger systems, and more particularly to heat exchanger arrangements that are useful in systems for incinerating organic vapors and the like.

It is frequently desirable to process organic vapors by thermal incineration (or thermal oxidation) to avoid air pollution. In such systems, the organic vapors are subject to combustion and discharged at a temperature on the order of 1400° F. and the hot incineration discharge is desirably used to preheat the input dilute vapor mixture, in a heat exchanger, so that less fuel is required to operate the process. In such systems, the pressure of the vapor mixture supplied through the heat exchanger is usually at a higher pressure than the combustion chamber exhaust as it is typically not desirable to locate the fan or other pressurizing device in the hottest zone due to factors such as added expense and inefficiencies. In such arrangements, should a leak develop in the heat exchanger, unburned vapors at higher pressure may flow (in short circuit path) into the combustion chamber exhaust side and may be incompletely oxidized and form aldehydes that are more noxious and polluting than the initial vapors.

In accordance with the invention there is provided a heat exchanger—combustion chamber construction that includes structure defining a combustion chamber and structure defining a heat exchanger chamber. Disposed in the heat exchanger chamber is an array of inlet tubes, the outlets of which discharge into the combustion chamber. Combustion products discharged from the combustion chamber are flowed over the inlet tubes in heat exchange relation. An array of aspirator sleeves of larger inner dimension than the outer dimension of the inlet tubes is secured to divider structure between the heat exchanger chamber and the combustion chamber, each aspirator sleeve receiving the outlet end of a heat exchanger tube while permitting lontigudinal movement of the heat exchanger tube within the sleeve (due to thermal expansion, for example). Inlet vapor flow through the tubes produces a reduced pressure effect in the sleeves to a value below the pressure of the exhaust gas in the heat exchanger chamber so that there is recycle flow of a small fraction of the combustion products through the aspirator sleeves back into the combustion chamber.

In preferred embodiments, the outlet end of the aspirator sleeve extends at least one outlet diameter beyond the end of the tube received within the sleeve. The supply tube configuration may be varied depending on the application and in particular embodiments may be of either straight sided or have a reduced discharge end dimension. In particular embodiments, the inlet end of each aspirator sleeve is secured to the heat exchanger-combustion chamber divider wall by a rolled seal, the sleeve does not extend more than four diameters from the discharge end of the heat exchanger tube, and each heat exchanger tube is similarly secured to the inlet wall of the heat exchanger chamber wall by a rolled seal. Baffles in the heat exchanger chamber provide a tortutous path for the flow of combustion products through the heat exchanger chamber, and a parallel bypass channel is provided together with damper structure to allow a portion of the combustion products to bypass the heat exchanger chamber as desired.

Others features and advantages of the invention will be seen as the following description of a particular embodiment progresses, in conjunction with the drawings in which.

DESCRIPTION OF PARTICULAR EMBODIMENT

Figure 1:
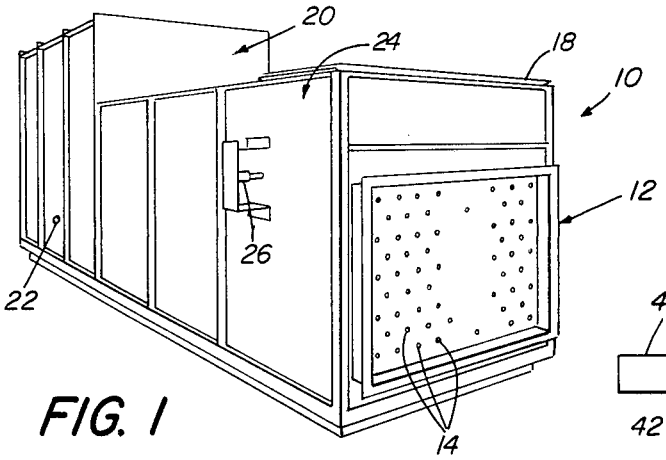
FIG. 1 is a perspective view of an incineration system in accordance with the invention.
Figure 2:
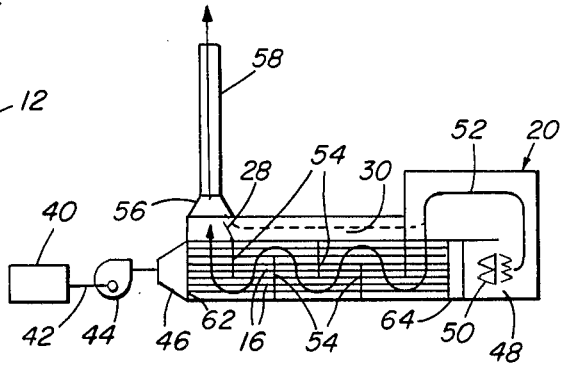
FIG. 2 is a diagrammatic view of the incineration system shown in FIG. 1.

The incineration system shown in FIG. 1 includes a housing 10 that has inlet flange 12 in which the inlet ends 14 of an array of heat exchanger tubes 16 are exposed; and outlet flange 18; a combustion chamber section 20 with fuel gas inlet 22; and a heat exchanger chamber section 24 in which tubes 16 are disposed, together with control 26 for operating damper 28 that controls or directs exhaust gas flow either through a heat exchanger chamber 24 or bypass duct 30 (FIG. 2). Housing 10 has a length of about twenty-seven feet, a height of about ten feet at its combustion chamber end, a height of about seven feet at its inlet end, and a width of about seven and one-half feet.

As shown in the diagram of FIG. 2, vapors from a web-drying process diagrammatically indicated at 40 are transported through line 42 and blower 44 to coupling 46 which is secured to inlet flange 12 of the incineration system. The vapor mixture flows through heat exchanger tubes 16 into combustion chamber 48 in which burner 50 is mounted. The gases exhausted from combustion chamber 48 flow along path 52 for return through the heat exchanger chamber 24 over the tubes 16 as directed by baffles 54 for discharge through coupling 56 secured to outlet flange 18 and exhaust stack 58 to the atmosphere.

Figure 6:
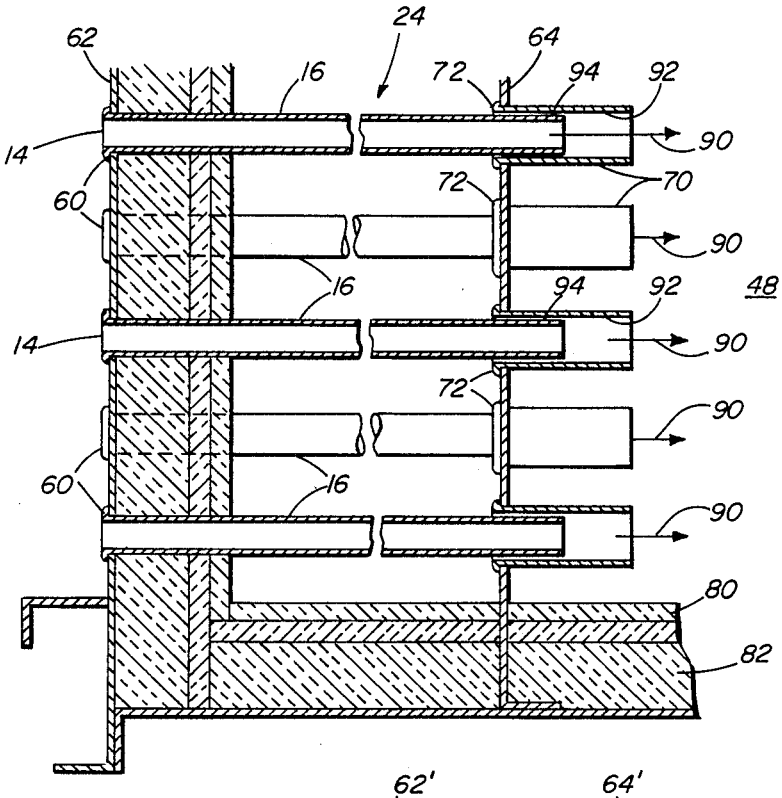
FIG. 6 is a diagrammatic view of the heat exchanger tube and aspirator sleeve construction employed in the incineration system shown in FIG. 1.

Further details of the incineration system may be seen with reference to FIGS. 3–6. The system includes an array of one hundred fifty eight stainless steel tube (of sixteen gauge wall and two inch outer diameter) that are eighteen feet long with their inlet ends 60 rolled into inlet heat exchanger wall 62 and sealed to that wall, and the tubes extending through baffle plates 54 and through heat exchanger outlet chamber wall 64, each tube 16 extending about two inches beyond wall 64. Secured to chamber wall 64 is an outlet or aspirator sleeve 70 that has an inlet end 72 rolled into and sealed to wall 64 as indicated in FIG. 6. Each aspiration sleeve 70 is a stainless steel sixteen gauge wall two and one quarter inch outer diameter and a length of six inches. Wall 64 separates a heat exchanger chamber 24 from the combustion chamber 48 in which burner 50 (Maxon Combustifume Burner LV Model) is disposed. Fire wall structure 80 and thermal insulation 82 line the heat exchanger chamber 24 and the combustion chamber 48;

and divider wall 84 separates heat exchanger chamber 24 from bypass duct 30.

Further details of the heat exchanger tube-aspiration sleeve structure may be seen with reference to FIG. 6. In operation, vapors from process 40 are flowed under pressure by blower 44 into tubes 16 at variable flow rates of up to about 12,000 scfm to produce discharge velocities of about 8000 feet per minute (based on hot gas) at the entry to combustion chamber 48. The vapors are subjected to an incineration process in chamber 48 with the combustion products being discharged from combustion chamber 48 at a pressure of less than about one inch of water and a temperature of about 1,400° F. for flow through the heat exchanger chamber 24 as directed by baffles 54 to the outlet coupling 56 and stack 58.

With reference to FIG. 6, the high velocity discharge of the vapors from tubes 16 (indicated by arrows 90) creates regions of reduced pressure between the inner surface 92 of each aspiration sleeve 76 and the outer surface of tube 16. The slip fit between tube 16 and aspiration sleeve 76 provides a path for recycle flow of a small fraction of combustion products back into the combustion chamber 48, thus providing an effective dynamic seal that blocks short circuit flow of the input gas stream and incorporates thermal expansion compensation for the heat exchanger tubes 16.

Figure 7:
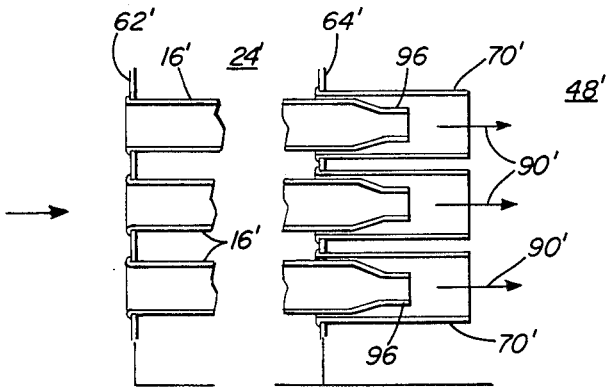
FIG. 7 is a diagrammatic view, similar to FIG. 6, of an alternate heat exchanger tube-aspirator sleeve construction in accordance with the invention.
Figure 3:
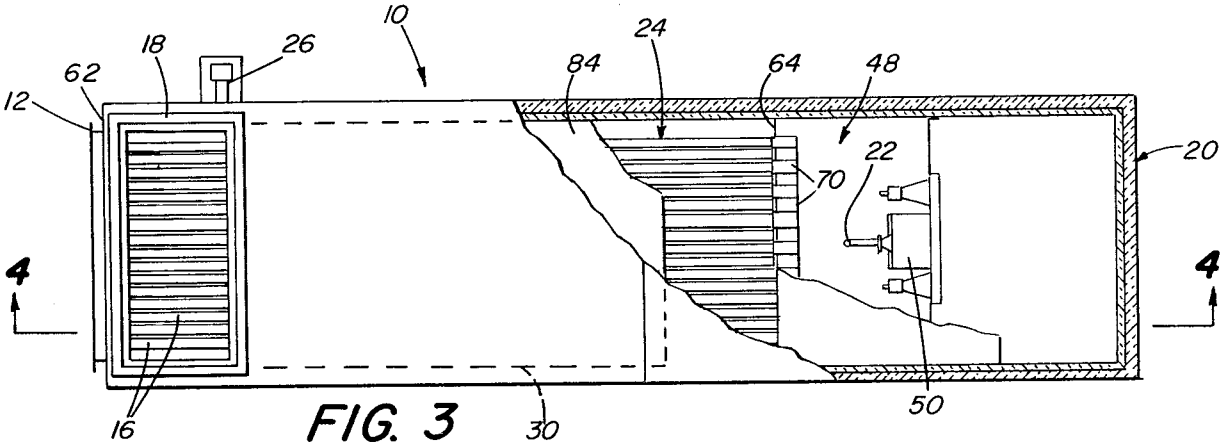
FIG. 3 is a top plan view of the incineration system shown in FIG. 1 with parts broken away.
Figure 4:
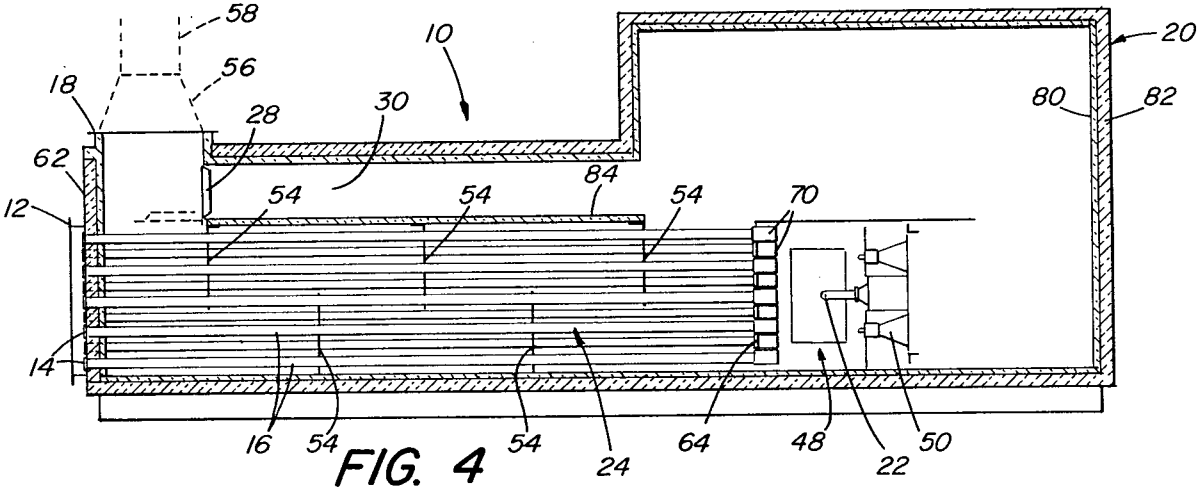
FIG. 4 is a sectional view taken along the line 4—4 of FIG. 3.
Figure 5:
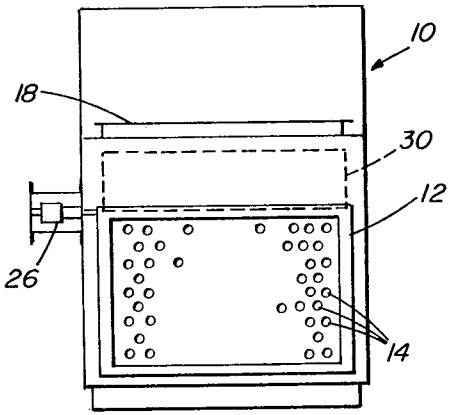
FIG. 5 is an end view of the incineration system shown in FIG. 1.

In another heat exchanger construction shown in FIG. 7, tubes 16' have ends 96 of reduced diameter to provide velocity enhancement of discharged vapor in jets 90' to provide a similar zone of reduced pressure between each aspirator sleeve tube 70' and the heat exchanger tube 16' which draws product from the heat exchanger chamber 24' through the aspirator sleeves 70' into the combustion chamber 48' for reincineration.

While particular embodiments of the invention have been shown and described, various modifications thereof will be appararent to those skilled in the art, and therefore it is not intended that the invention be limited to the disclosed embodiments or to details thereof, and departures may be made therefrom within the spirit and scope of the invention.

What is claimed is:

1. An incineration system comprising combustion chamber structure having an inlet, an outlet, and burner structure in said combustion chamber, heat exchanger structure defining a chamber, divider structure between said heat exchanger chamber and said combustion chamber, an array of tubes extending through said heat exchanger chamber to the inlet of said combustion chamber at said divider structure, said heat exchanger chamber having an inlet coupled to the outlet of the combustion chamber for flow of the combustion products discharged from said combustion chamber through said heat exchanger chamber over said tubes in heat exchange relation, and an outlet for discharge of products from said heat exchanger chamber, aspirator sleeve structure secured to said divider structure between said heat exchanger chamber and said combustion chamber, each said aspirator sleeve receiving the outlet end of a heat exchanger tube in slip fit relation so that said heat exchanger tubes are free to thermally expand longitudinally within said aspirator sleeves, and means for flowing vapor through said heat exchanger tubes into said combustion chamber at sufficiently high velocity to produce a reduced pressure effect in said aspirator sleeves to reduce the pressure in said aspirator sleeves below the exhaust gas pressure in said heat exchanger chamber to draw a minor fraction of combustion products through said aspirator sleeves into said combustion chamber for reincineration.

2. The system of claim 1 wherein the outlet end of each heat exchanger tube extends at least one tube in diameter into its said aspirator sleeve and each said aspirator sleeve extends at least one tube diameter beyond the outlet end of its said heat exchanger tube.

3. The system of claim 2 wherein each said aspirator sleeve terminates within four diameters of the discharge end of the heat exchanger tube disposed within it.

4. The system of claim 1 wherein said heat exchanger tubes are of uniform cross sectional dimension along their length.

5. The system of claim 1 wherein portions of said heat exchanger tubes disposed in said aspirator sleeves are of reduced cross sectional dimension.

6. The system of claim 1 wherein said heat exchanger structure includes an inlet header wall in which the inlet ends of said heat exchanger tubes are secured and an outlet header wall in which the inlet ends of said aspirator sleeves are secured.

7. The system of claim 6 wherein the inlet ends of said heat exchanger tubes are secured to said inlet header wall and the inlet ends of said aspirator sleeves are secured to said outlet header wall by rolled metal seals.

8. The system of claim 7 wherein the outlet end of each heat exchanger tube extends at least one tube in diameter into its said aspirator sleeve and each said aspirator sleeve extends between one and four tube diameters beyond the discharge end of the heat exchanger tube disposed within it.

9. The system of claim 8 wherein said heat exchanger tubes are of uniform cross sectional dimension along their length.

10. The system of claim 8 wherein portions of said heat exchanger tubes disposed in said aspirator sleeves are of reduced cross sectional dimension.

11. The system of claim 8 and further including baffle structure in said heat exchanger chamber for providing a tortuous flow passage for combustion products from said combustion chamber through said heat exchanger chamber over said tubes, structure defining a channel bypassing said tortuous flow passage, and damper structure for selective control of the flow of combustion products from said combustion chamber outlet to said heat exchanger outlet through said bypass channel and said tortuous flow passage.

* * * * *